US007556005B2

(12) United States Patent
Tachino et al.

(10) Patent No.: US 7,556,005 B2
(45) **Date of Patent: *Jul. 7, 2009**

(54) AUTOMATIC TAPPET CLEARANCE ADJUSTING DEVICE AND METHOD

(75) Inventors: Yasuyuki Tachino, Sayama (JP); Toshiyuki Miyajima, Sayama (JP); Tomoaki Tsuyoshi, Sayama (JP)

(73) Assignee: Honda Motor Co., Ltd., Tokyo (JP)

( * ) Notice: Subject to any disclaimer, the term of this patent is extended or adjusted under 35 U.S.C. 154(b) by 174 days.

This patent is subject to a terminal disclaimer.

(21) Appl. No.: 11/664,197

(22) PCT Filed: Sep. 28, 2005

(86) PCT No.: PCT/JP2005/017896

§ 371 (c)(1),
(2), (4) Date: Mar. 29, 2007

(87) PCT Pub. No.: WO2006/035844

PCT Pub. Date: Apr. 6, 2006

(65) Prior Publication Data

US 2007/0266972 A1 Nov. 22, 2007

(30) Foreign Application Priority Data

Sep. 29, 2004 (JP) ..... 2004-283089

(51) Int. Cl.
*F01L 1/14* (2006.01)

(52) U.S. Cl. ..... 123/90.48; 123/90.39; 123/90.52; 123/90.54

(58) Field of Classification Search ..... 123/90.48, 123/90.52, 90.54, 90.55, 90.39, 90.44, 90.45, 123/90.46

See application file for complete search history.

(56) References Cited

U.S. PATENT DOCUMENTS 6,205,850 B1 * 3/2001 Wehrman et al. ..... 73/114.79
6,917,874 B2 * 7/2005 Uchida et al. ..... 701/108

FOREIGN PATENT DOCUMENTS

| | | |
|---|---|---|
| GB | 1 603 113 | 11/1981 |
| JP | 56-077505 | 6/1981 |
| JP | 58-057016 | 4/1983 |
| JP | 63-266105 | 11/1988 |

(Continued)

*Primary Examiner*—Ching Chang
(74) *Attorney, Agent, or Firm*—Carrier, Blackman & Associates, P.C.; Joseph P. Carrier; William D. Blackman

(57) ABSTRACT

An automatic tappet clearance adjuster comprising a unit for adjusting the projection by advancing/retracting an adjust screw from the forward end of a rocker arm, a section for detecting the torque by rotating the adjust screw, and a control mechanism section for controlling the adjusting unit according to the torque value measured by the torque detecting section. The control mechanism section measures the torque value continuously when a valve is closed by retracting the adjust screw from the open state of the valve. A rotation reference position corresponding to the intersection of a first approximation line and a second approximation line approximating the sections immediately before and after the inflection point of differential value of the torque value is detected as a reference point, and the adjust screw is retracted by a set amount from the reference point.

14 Claims, 13 Drawing Sheets

FOREIGN PATENT DOCUMENTS

| | | |
|---|---|---|
| JP | 06-017619 | 1/1994 |
| JP | 09-177520 | 7/1997 |
| JP | 09-303120 | 11/1997 |
| JP | 10-077812 | 3/1998 |
| JP | 11-153007 | 6/1999 |
| JP | 2001-027106 | 1/2001 |
| JP | 2002-115512 | 4/2002 |
| JP | 2004-245111 | 9/2004 |

* cited by examiner

AUTOMATIC TAPPET CLEARANCE ADJUSTING DEVICE AND METHOD

CROSS-REFERENCE TO RELATED APPLICATIONS

The present application is a U.S. National phase of, and claims priority based on PCT/JP2005/017896, filed 28 Sep. 2005, which, in turn, claims priority from Japanese patent application 2004-283089, filed 29 Sep. 2004. The entire disclosure of each of the referenced priority documents is incorporated herein by reference.

BACKGROUND ART

Engines of the type in which a rocker arm is provided in a valve mechanism draw in and discharge a fuel gas and an exhaust gas by pressing a valve end, so as to open the valve with an adjustment screw on the distal end of a rocker arm that is actuated by a cam. When the rocker arm returns to an original position, the valve is closed again under a resilient force of a spring.

A clearance (hereinafter referred to as a tappet clearance) is provided between the valve end and the adjustment screw, for allowing the valve to be fully closed when the rocker arm returns to the original position. If the tappet clearance is too small, then the clearance may possibly be eliminated due to thermal expansion at high temperatures. If the tappet clearance is too large, then the valve end and the adjustment screw produce large sounds as noise when they contact each other. Therefore, the tappet clearance has to be adjusted accurately to an appropriate value (or within an appropriate range) that is preset in design. Particularly, a process for manufacturing a large quantity of engines in a wide variety of types needs to have a reduced adjustment time per engine, while maintaining a high adjustment accuracy level. It is preferable to be able to adjust the tappet clearance automatically in order to prevent adjustment fluctuations.

Processes for adjusting tappet clearance are disclosed in Japanese Patent Publication No. 62-8609, Japanese Laid-Open Patent Publication No. 11-153007, and Japanese Laid-Open Patent Publication No. 2001-27106. An adjustment apparatus used by the process disclosed in Japanese Patent Publication No. 62-8609 has an actuator for rotating a driver, a displacement measuring device for measuring displacement of a valve in directions in which the valve is opened and closed, and a means for engaging a rocker arm to press a pad surface of the rocker arm against a cam surface. The means for engaging the rocker arm has a pressing lever element for pressing the pad surface against the cam surface under strong forces. The pressing lever element presses the pad surface reliably against the cam surface for increased adjustment accuracy.

According to the process described in Japanese Patent Publication No. 11-153007, the tappet clearance is adjusted while the pressure in the combustion chamber that is supplied with air under high pressure is being monitored. The tappet clearance can be adjusted accurately almost without requiring any skill. According to the process described in Japanese Laid-Open Patent Publication No. 2001-27106, a point of origin for adjustment is determined from a point where the displacement of the rocker arm is reduced by a reference quantity.

The pressing lever element used by the process described in Japanese Patent Publication No. 62-8609 is complex in structure, as it needs an air microcylinder for actuation and a rotational pivot shaft as a lever mechanism. Since the pressing lever element is separate from the displacement measuring device, the apparatus is large in size.

According to the process described in Japanese Laid-Open Patent Publication No. 11-153007, because the pressure in the combustion chamber is relatively high, air flow tends to be disturbed, and hence accurate measurements cannot be made until the pressure in the combustion chamber is stabilized. Accordingly, it may be difficult to adjust the tappet clearance quickly. Furthermore, since a worker uses a screwdriver to adjust the distance at which an adjustment screw is threaded in, it is desirable to make the process automatic in order to reduce the burden on the worker, as well as to adjust the tappet clearance with higher accuracy in a shorter period of time.

According to the process described in Japanese Laid-Open Patent Publication No. 2001-27106, a worker determines the point of origin for adjustment based on displacement of the rocker arm. Consequently, the process requires a sensor for detecting displacement, and requires that a sensor signal be linked to the adjustment apparatus. The reference quantity for the determined displacement has to be converted into a rotational angle and an advanced distance, based on a relationship between the pitch and lead of the adjustment screw, and the worker has to determine a final completion point.

DISCLOSURE OF THE INVENTION

It is an object of the present invention to provide an automatic tappet clearance adjusting apparatus and an adjusting method for adjusting the clearance between a valve and an adjustment screw, so that such adjustments can be made more quickly and accurately with simple structures and means.

It is also an object of the present invention to detect bidirectional torques with simple and inexpensive structures for adjusting a tappet clearance.

According to the present invention, an automatic tappet clearance adjusting apparatus for adjusting a clearance between a valve and an adjustment screw in an engine, in which the valve that is closed by a spring is opened by being pressed by an adjustment screw on a distal end of a rocker arm, comprises an adjustment unit for advancing and retracting the adjustment screw from a distal end of the rocker arm to adjust a projection of the adjustment screw, a torque detector for detecting a torque to rotate the adjustment screw, and a control mechanism for controlling the adjustment screw based on a torque value measured by the torque detector, wherein the control mechanism successively detects the torque value applied to retract the adjustment screw to close the valve from a state in which the valve is open, and detects, as a reference point, a point of intersection of a first approximate line, which approximates a zone immediately before an inflection point at which the differential value of the torque value changes, with a second approximate line which approximates a zone immediately after the inflection point, and then retracts the adjustment screw by a set quantity based on the clearance from the reference point.

Since the torque value applied to retract the adjustment screw to close the valve is successively measured, a time at which the differential value of the torque value changes can reliably be identified. An intersection point is determined from a first approximate straight line, which approximates a zone immediately before the time, and a second approximate straight line, which approximates a zone immediately after the time is determined. Therefore, even when the torque value changes along a curve, the first approximate straight line and the second approximate straight line are set in the vicinity of the inflection point, and a reference point corresponding to the inflection point can accurately be identified. By retracting the adjustment screw by a set quantity based on the clearance from the reference point, the clearance between the valve and the adjustment screw can be adjusted quickly and highly accurately.

The control mechanism detects, as the reference point, an inflection point at which a valve head of the valve contacts a valve seat of the engine to begin reducing the torque value. Alternatively, the control mechanism may detect, as the reference point, an inflection point at which after the valve head of the valve contacts the valve seat of the engine, the adjustment screw is spaced from an end of the valve to hold the torque value at a constant value.

Since the inflection point of the torque value at the time the valve is retracted is identified as a reference point, the reference point can be identified highly accurately regardless of play of a tool in the adjustment unit that engages the adjustment screw, backlash of the drive system, etc.

The torque detector comprises a drive unit connected to a rotary drive source, a driven unit coupled to a tool for rotating the adjustment screw, the driven unit being coaxial with the drive unit, a drive force transmitting engagement unit for transmitting rotation in both directions of the drive unit to the driven unit, and a load cell disposed in the drive force transmitting engagement unit, for detecting a force in one circumferential direction, wherein the load cell may be preloaded in the one circumferential direction by a resilient body.

Because the load cell is preloaded by the resilient body, the torque detector has no clearance, and the load cell is capable of measuring torques in a manner free of dead zones. The torque detector can detect bidirectional torques with a simple arrangement employing a single load cell.

The automatic tappet clearance adjusting apparatus may further comprise a rocker arm measuring unit for detecting displacement of the rocker arm, and a moving mechanism programmed for setting a position and direction of the adjustment unit, wherein the moving mechanism sets the position and direction of the adjustment unit based on the displacement of the rocker arm measured by the rocker arm measuring unit, and brings the adjustment unit into engagement with the adjustment screw. The adjustment unit and the adjustment screw can thus be brought into reliable engagement with each other.

If the adjustment unit is moved by a programmable multi-axis robot, then the adjustment unit is flexible enough to handle engines in which the rocker arms and adjustment screws thereof have different positions and directions.

If the automatic tappet clearance adjusting apparatus is installed in a station on a production line, then the automatic tappet clearance adjusting apparatus can suitably be used to adjust mass-produced engines.

According to the present invention, an automatic tappet clearance adjusting method, for adjusting a clearance between a valve and an adjustment screw in an engine in which the valve that is closed by a spring is opened by being pressed by an adjustment screw on a distal end of a rocker arm, comprises the step of employing an adjustment unit for advancing and retracting the adjustment screw from the distal end of the rocker arm in order to adjust the projection of the adjustment screw, a torque detector for detecting a torque value to rotate the adjustment screw, and a control mechanism for controlling the adjustment screw based on the torque value as measured by the torque detector, wherein the control mechanism successively detects the torque value applied to retract the adjustment screw to close the valve from a state in which the valve is open, and detects, as a reference point, a point of intersection of a first approximate line, which approximates a zone immediately before an inflection point at which the differential value of the torque value changes, with a second approximate line which approximates a zone immediately after the inflection point, and then retracts the adjustment screw by a set quantity based on the clearance from the reference point.

BEST MODE FOR CARRYING OUT THE INVENTION

An automatic tappet clearance adjusting apparatus, and an adjusting method according to an embodiment of the present invention, shall be described below with reference to FIGS. 1 through 13 of the accompanying drawings.

Figure 1:
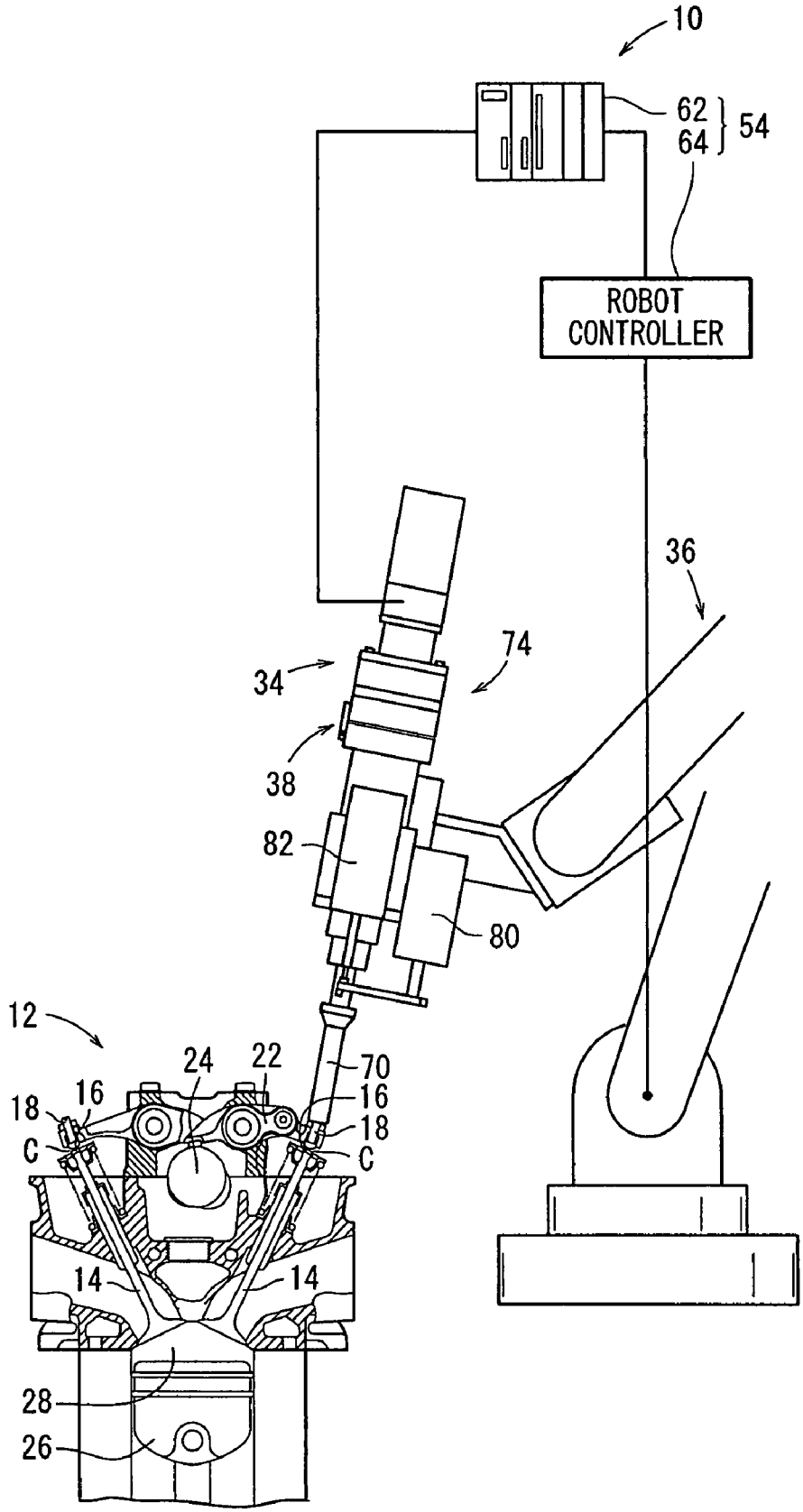
FIG. 1 is a block diagram of an automatic tappet clearance adjusting apparatus according to an embodiment of the present invention.

As shown in FIG. 1, an automatic tappet clearance adjusting apparatus 10 according to an embodiment of the present invention operates to adjust a clearance (hereinafter referred to as a tappet clearance) C between a valve end 16 of a valve 14 of an engine 12 and an adjustment screw 18. The adjustment screw 18 is a fine right-handed screw, which is advanced downwardly when rotated clockwise.

Figure 2:
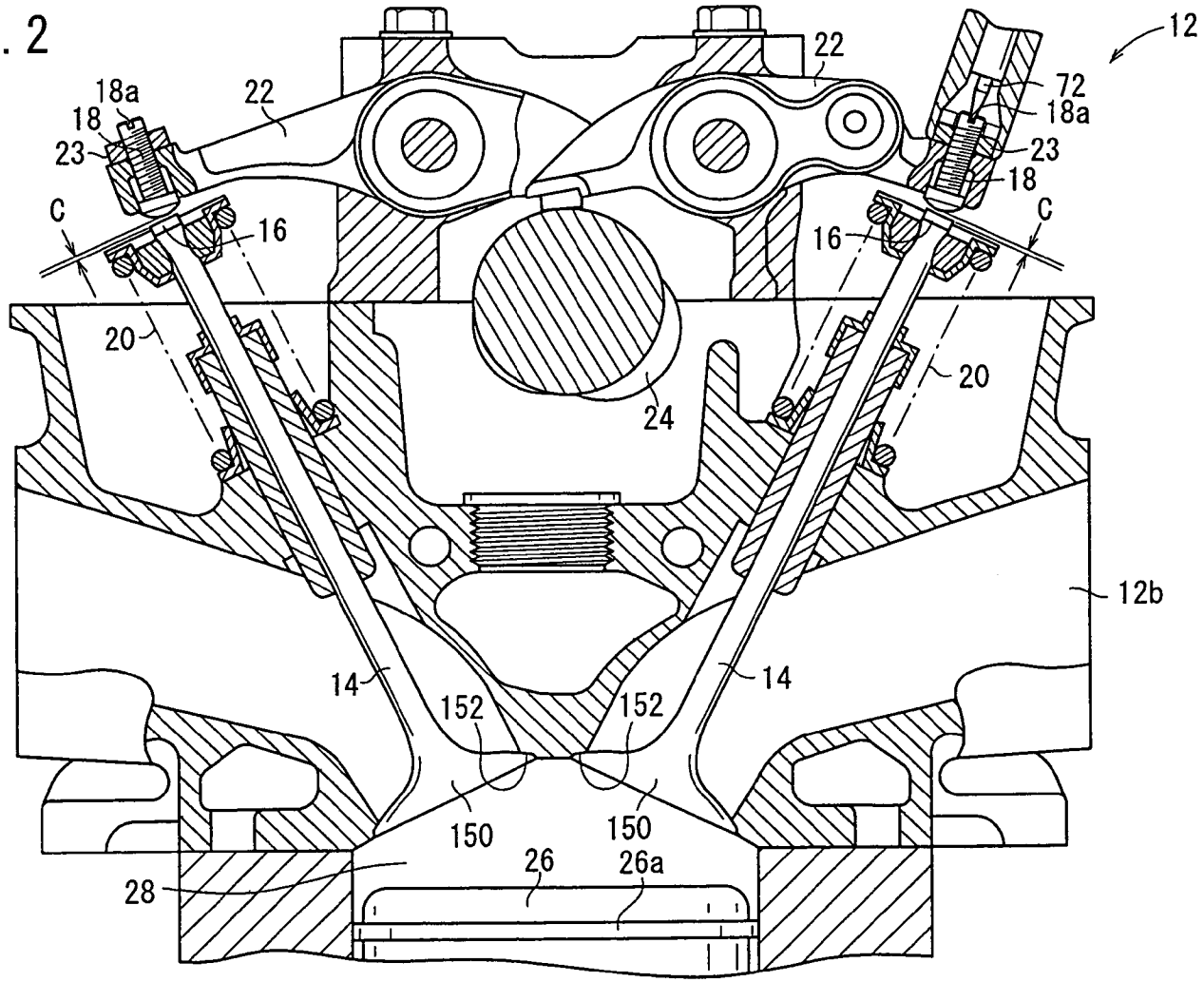
FIG. 2 is a cross-sectional view of an engine.

As shown in FIG. 2, the adjustment screw 18 has a screw section having a straight slot 18*a* defined in an upper end thereof, the screw section being threaded in the distal end of a rocker arm 22. The adjustment screw 18 is fixed in place by an adjustment nut 23, by means of a double-nut configuration. The engine 12 is of a type wherein the valve end 16 of the valve 14, which is closed by a spring 20, is pressed by the adjustment screw 18 on the distal end of the rocker arm 22 in order to open the valve 14. Specifically, the rocker arm 22 is actuated by a cam 24 so as to cause the adjustment screw 18 to press the valve end 16, for thereby opening the valve 14 to draw in a fuel gas or to discharge an exhaust gas. When the rocker arm 22 returns to its original position, the valve 14 is closed again under the resiliency of the spring 20.

For adjusting the clearance C, the cam 24 is set so that the cam lobe thereof is directed downwardly and the rocker arm 22 returns to its original position. Therefore, in both intake and exhaust strokes, the valves 14 are placed in positions for closing an intake pipe and an exhaust pipe, respectively, and a piston 26, which is ganged with the cam 24, is lifted to a top dead center position, providing a combustion chamber 28 as a small space.

With the adjustment nut 23 being loosened, the adjustment screw 18 advances or retracts in order to change the tappet clearance C when it is turned by a screwdriver (tool) 72 inserted into the straight slot 18*a* defined in the rear end of the adjustment screw 18. When the tappet clearance C is adjusted to a suitable value, the adjustment nut 23 is tightened in order to secure the adjustment screw 18.

Referring back to FIG. 1, the automatic tappet clearance adjusting apparatus 10 has an adjustment unit 34 for advancing and retracting the adjustment screw 18 after having loosened the adjustment nut 23, a robot (moving mechanism) 36 programmed for moving the adjustment unit 34 to a desired position in a desired direction, a torque detector 38 for detecting a torque for rotating the adjustment screw 18, and a control mechanism 54 for controlling the adjustment unit 34 based on a torque value T measured by the torque detector 38.

The control mechanism 54 includes a PLC (Programmable Logic Controller) 62 and a robot controller 64. The PLC 62 stores successive torque values T in a given data register, calculates reliable differential values, controls the adjustment unit 34 based on the calculated results, etc., and transmits a predetermined timing signal to the robot controller 64. Based on the received timing signal, the robot controller 64 controls the robot 36 to move and bring the distal end of the adjustment unit 34 into abutment against the adjustment screw 18. The robot 36 comprises a multiaxis industrial robot.

Figure 3:
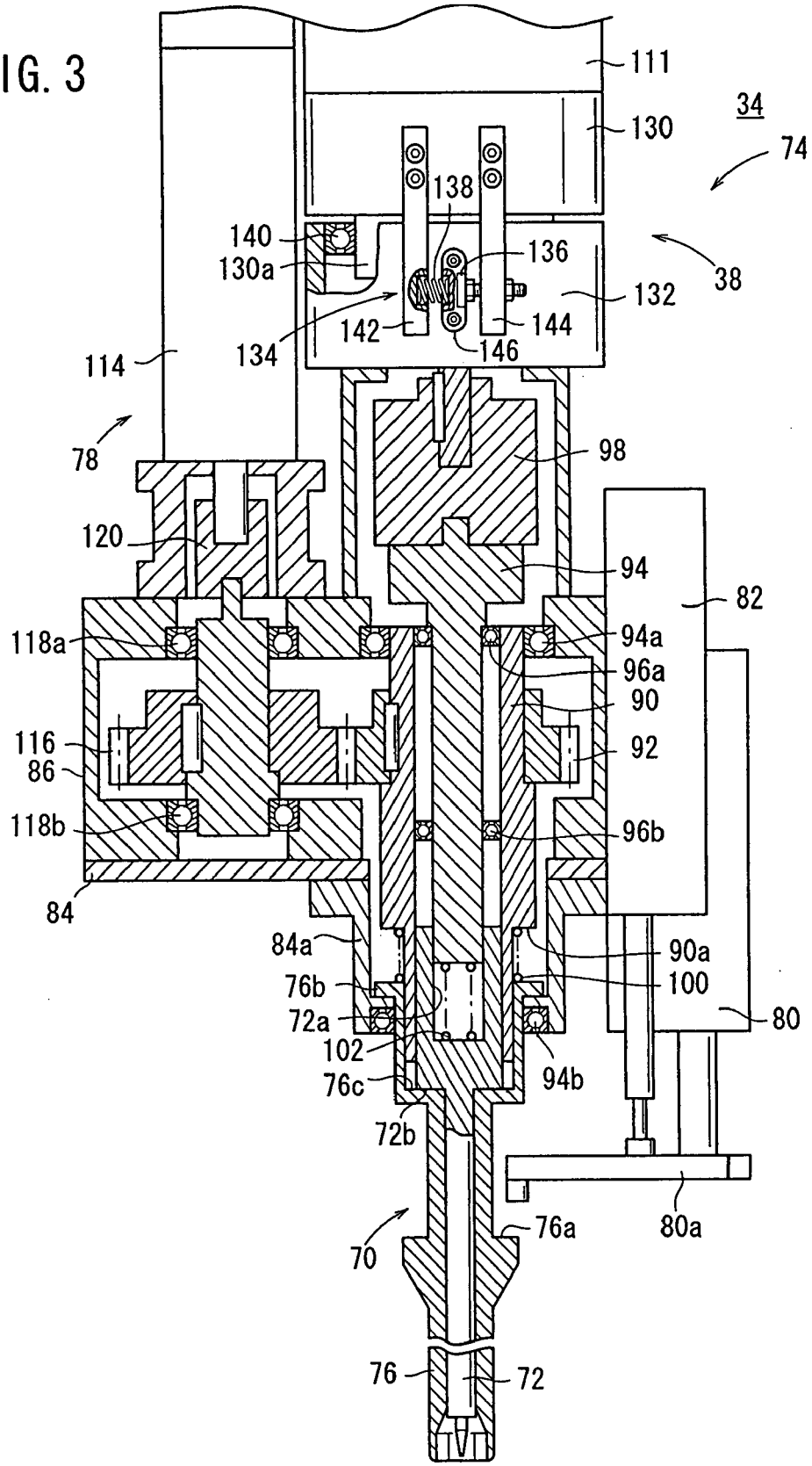
FIG. 3 is a sectional front elevational view of an adjustment unit.
Figure 4:
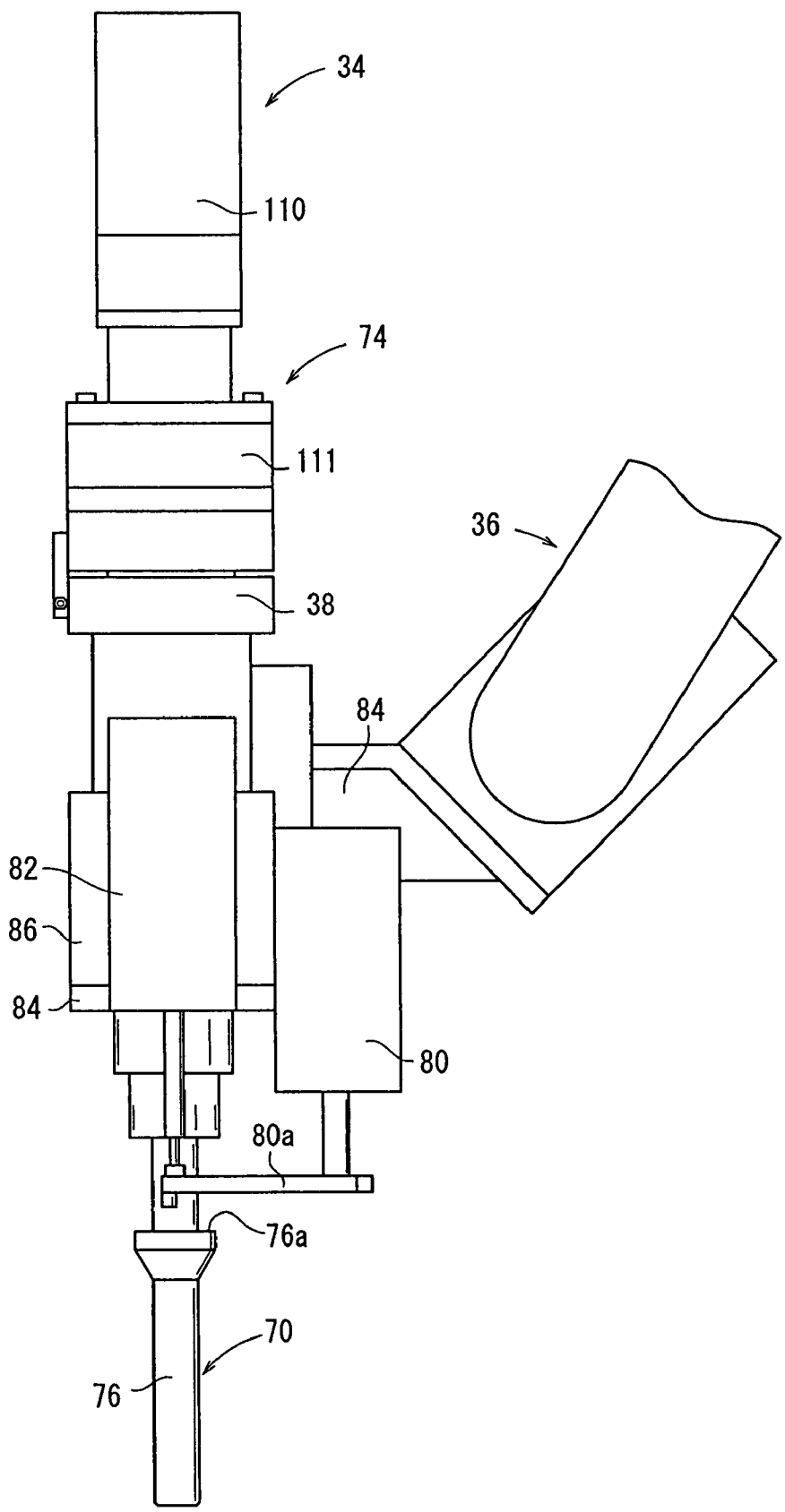
FIG. 4 is a side elevational view of the adjustment unit.

As shown in FIGS. 3 and 4, the adjustment unit 34 is mounted on the distal end of the robot 36. The adjustment unit 34 comprises a cylindrical working unit 70 for operating the adjustment screw 18 and the adjustment nut 23, a screwdriver 72 mounted in the distal end of a core shaft of the working unit 70, a screwdriver rotator 74 for actuating the screwdriver 72, a socket 76 disposed coaxially around the screwdriver 72, a nut runner 78 for actuating the socket 76, a pneumatic cylinder 80 for bringing a plate 80*a* into abutment against a detecting seat 76*a* in order to measure a distance by which the socket 76 is advanced or retracted, and a magnescale (rocker arm measuring unit) 82 coupled to the plate 80*a* for measuring the position of the detecting seat 76*a* in order to detect displacement of the rocker arm 22 in real time. The pneumatic cylinder 80 and the magnescale 82 are mounted on a joint bracket 84 connected to the robot 36. For making such measurements, the pneumatic cylinder 80 may be small in size and weight and does not need to produce a large output.

The screwdriver rotator 74 is mounted coaxially with the working unit 70 on an upper surface of the joint bracket 84 by a casing 86. The nut runner 78 is disposed adjacent and parallel to the screwdriver rotator 74, and extends upwardly from an upper surface of the casing 86.

The working unit 70 projects downwardly from the joint bracket 84, while the screwdriver 72 and the socket 76 are disposed on the distal end of the working unit 70. The working unit 70 has a rotary tube 90 with a distal end having splines fitted into an upper hole in the socket 76, a driven gear 92 coaxially fixed onto the rotary tube 90 in the casing 86, and a coupling rod 94 extending through an axial hole in the rotary tube 90 and with a distal end having splines fitted into an upper hole 72*a* in the screwdriver 72.

The rotary tube 90 is rotatably supported by a bearing 94*a* in the casing 86 and a bearing 94*b* in a support tube 84*a* projecting downwardly from the joint bracket 84. When the driven gear 92 is rotated, the rotary tube 90 is rotated in unison therewith, and such rotation is transmitted by the splines to rotate the socket 76. The coupling rod 94 is rotatably supported by two bearings 96*a*, 96*b* disposed on an inner surface of the rotary tube 90. When a coupling 98 mounted on the upper end of the coupling rod 94 is rotated, the coupling rod 94 is rotated in unison therewith, and rotation is transmitted by the splines to rotate the screwdriver 72.

A spring 100 is disposed between a side step of the rotary tube 90 and an upper end face of the socket 76, so as to resiliently bias the rotary tube 90 downwardly. The socket 76 has an outer ring 76*b* on an upper portion thereof, which engages in an inner annular groove in the support tube 84*a* in order to prevent the socket 76 from becoming dislodged.

A spring 102 is disposed between the lower end face of the coupling rod 94 and the bottom of the upper hole 72*a* in the screwdriver 72 so as to resiliently bias the screwdriver 72 downwardly. The screwdriver 72 has an outer step 72*b*, which engages an inner step 76*c* of the socket 76 in order to prevent the screwdriver 72 from becoming dislodged.

The screwdriver 72 has a straight lower distal end for engaging in the straight slot 18*a*. The socket 76 has a lower distal end having an inner circumferential surface with a hexagonal socket shape for engagement with the adjustment nut 23.

The screwdriver rotator 74 comprises a servomotor 110, the angular displacement R of which can be detected, a speed reducer 111 for transmitting rotation of the servomotor 110 at a reduced speed to the coupling 98, and a torque detector 38. The servomotor 110, the speed reducer 111, and the torque detector 38 are successively arranged in series from above.

The nut runner 78 includes a motor 114, a drive gear 116 for transmitting rotation of the motor 114 at a reduced speed to the driven gear 92, and bearings 118*a*, 118*b* supporting the shaft of the drive gear 116. A coupling 120 is disposed between the rotational shaft of the motor 114 and the drive gear 116. The motor 114, the drive gear 116, the coupling 120, the driven gear 92, and the bearings 118*a*, 118*b* are housed within the casing 86.

The magnescale 82 is capable of detecting displacement of the rocker arm 22 in real time. Therefore, based on the measured displacement of the rocker arm 22, the robot 36 can set the position and direction of the adjustment unit 34 so as to reliably hold the socket and the adjustment nut 23 in engagement with each other, and also to reliably hold the screwdriver 72 and the adjustment screw 18 in engagement with each other.

The torque detector 38 comprises a stepped cylindrical drive unit 130, a hollow cylindrical driven unit 132 disposed coaxially with and downwardly from the drive unit 130, a drive force transmitting engagement unit 134 for transmitting rotation of the drive unit 130 to the driven unit 132, a load cell 136 mounted in the drive force transmitting engagement unit 134 for detecting force oriented in a circumferential direction, and a spring (resilient body) 138 for applying a circumferential preload to the load cell 136.

A bearing 140 is disposed between a downwardly projecting cylindrical member 130*a* of the drive unit 130 and an inner circumferential surface of the driven unit 132, thereby placing the driven unit 132 in a floating state. The driven unit 132 is connected to the screwdriver 72 by the coupling 98 and the coupling rod 94. The drive unit 130 and the driven unit 132 have essentially the same outside diameter.

Figure 5:
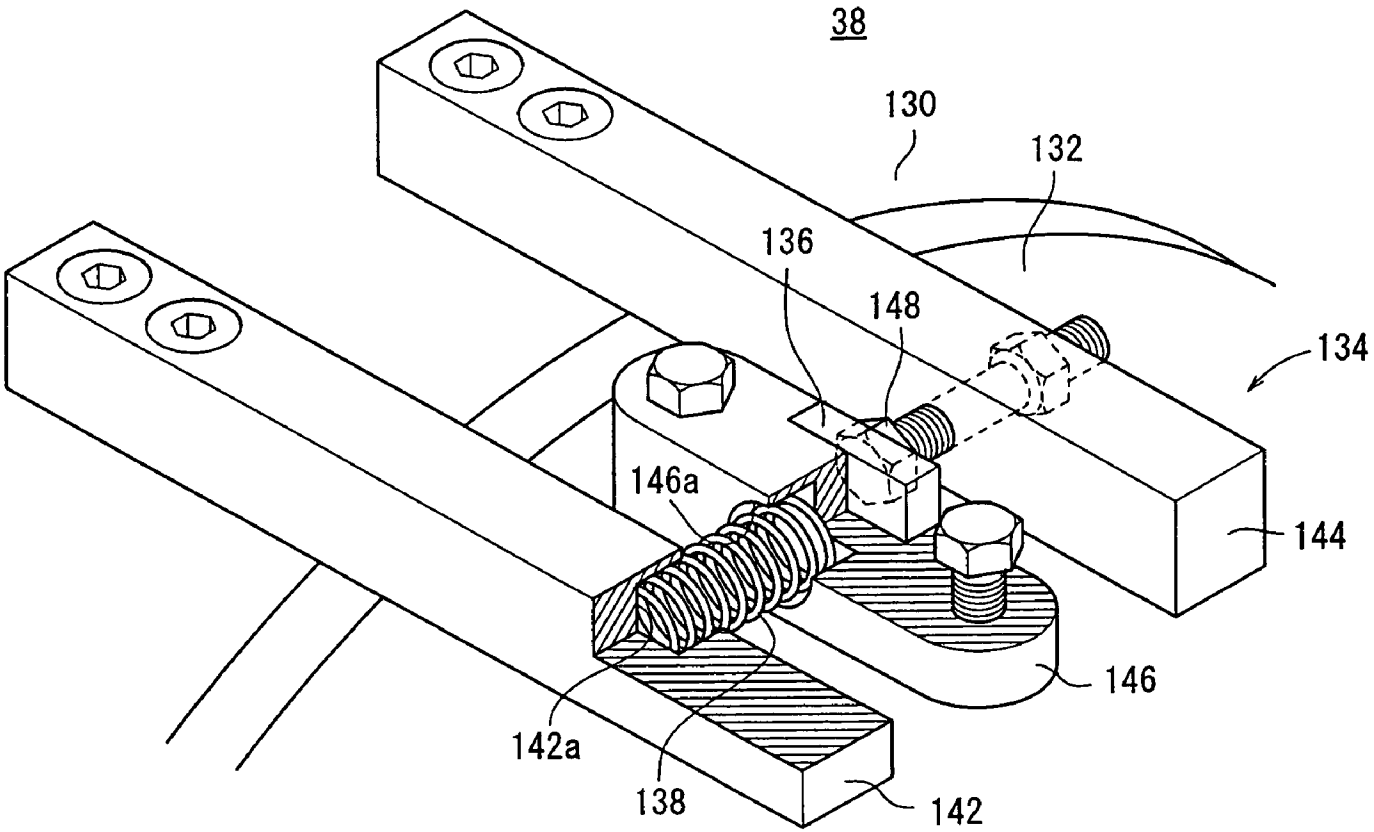
FIG. 5 is a perspective view, partly in cross section, of a torque detector.

As shown in FIG. 5, the drive force transmitting engagement unit 134 includes two fixing dogs 142, 144 mounted on a side surface of the drive unit 130 projecting downwardly (downwardly to the right in FIG. 5), and an engaging member 146 mounted on a side surface of the driven unit 132 and disposed between the fixing dogs 142, 144. As viewed from the engaging member 146, the fixing dog 142 is disposed on the left side and the fixing dog 144 is disposed on the right side.

The spring 138 has an end inserted into a bottomed circular hole 142*a* defined in a right side surface of the fixing dog 142, and the other end inserted into a bottomed circular hole 146*a* defined in a left side surface of the engaging member 146. The spring 138 is slightly compressed. The load cell 136 is mounted on a right side surface of the engaging member 146 and is held against an end of a pressing adjustment bolt 148 on the fixing dog 144. The pressing adjustment bolt 148 has a leftward projection, which is adjustable to adjust the compression of the spring 138. For example, if the load cell 136 has a measurement range of 100N, then the pressing adjustment bolt 148 is turned to adjust the compression of the spring 138 to apply a preload of 50N (=11N/2) to the load cell 136. Therefore, the torque applied in one direction to the driven unit 132 is proportionally detected as a force that is equal to or greater than 50N, and the torque applied in the reverse direction is proportionally detected as a force that is equal to or smaller than 50N. The force detected by the load cell 136 is supplied to the PLC 62, which subtracts the preload of 50N in order to cancel the offset, and then converts the force into a torque value T in view of the diameter of the driven unit 132.

According to a general torque detecting process for measuring circumferential strain using a strain gage, strain is small when the torque value is very small. Therefore, the general torque detecting process is not suitable for detecting very small torques applied to rotate the screwdriver 72, and further exhibits poor linearity.

The torque detector 38 can detect bidirectional torque values T, with a simple and inexpensive structure, using the single load cell 136. When the load cell 136 is preloaded by the spring 138, there is no clearance between the load cell 136 and the pressing adjustment bolt 148, making it possible to measure torques in a manner free of dead zones. Since the driven unit 132 is placed in a floating state with respect to the drive unit 130 due to the bearing 140, even very small torques can be measured highly accurately, without being affected by friction, and linearity is excellent.

Figure 6:
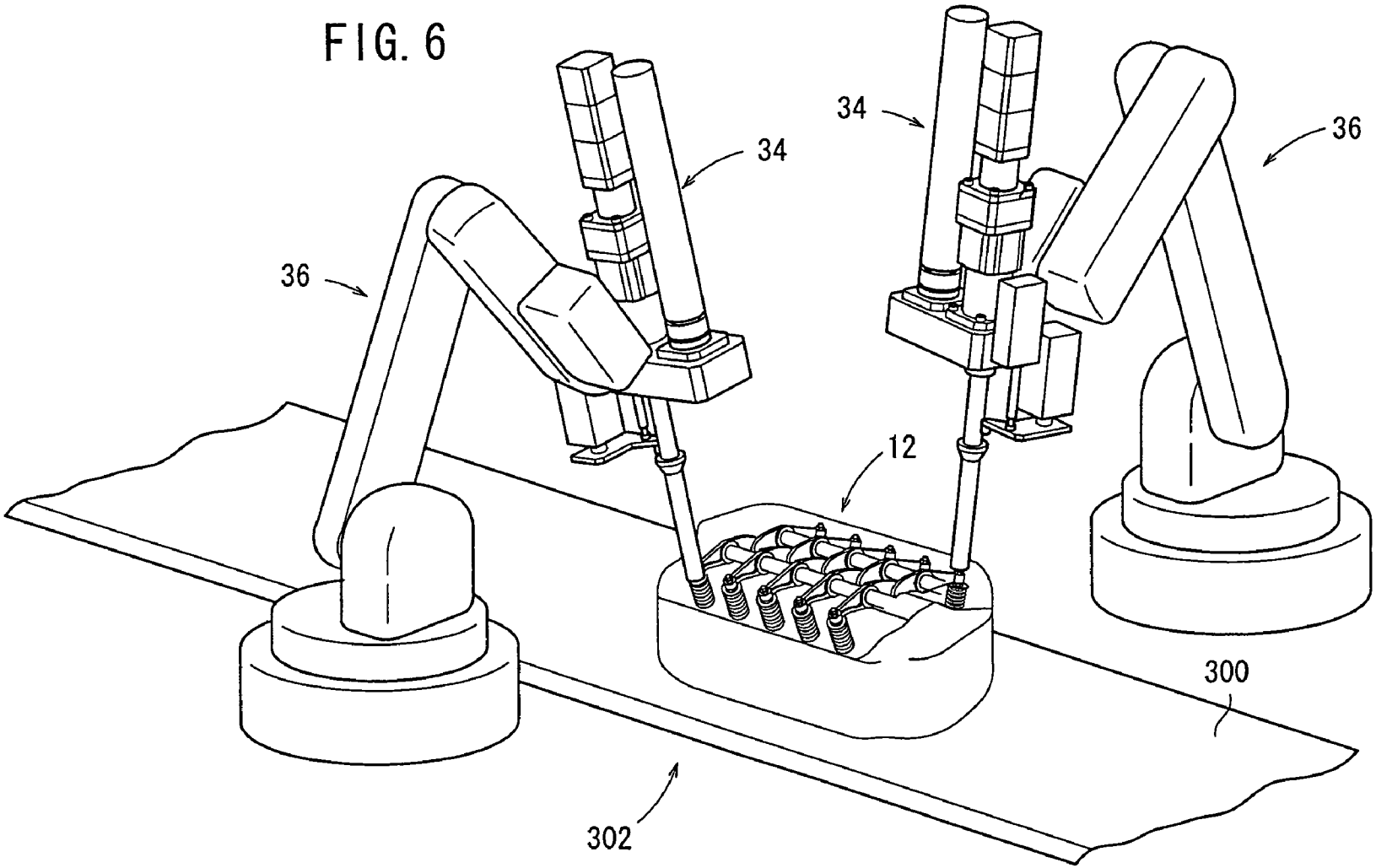
FIG. 6 is a perspective view of a station for making a tappet adjustment.

As shown in FIG. 6, the automatic tappet clearance adjusting apparatus 10 is installed in a station 302 on a production line 300. Engines 12 are successively fed along the production line 300. When an engine 12 is stopped at the station 302, the automatic tappet clearance adjusting apparatus 10 adjusts the tappet clearances C. After the tappet clearances C have been adjusted, the engine 12 is fed to a subsequent station. With this arrangement, the automatic tappet clearance adjusting apparatus 10 is capable of appropriately adjusting tappet clearances on mass-produced engines.

The station 302 has two automatic tappet clearance adjusting apparatuses 10 for sharing and adjusting adjustment screws 18, corresponding to a plurality of valves 14. Three or more automatic tappet clearance adjusting apparatuses 10 may be provided in a single station. The control mechanism 54 can be shared among all of the plural automatic tappet clearance adjusting apparatuses 10,.

Figure 7:
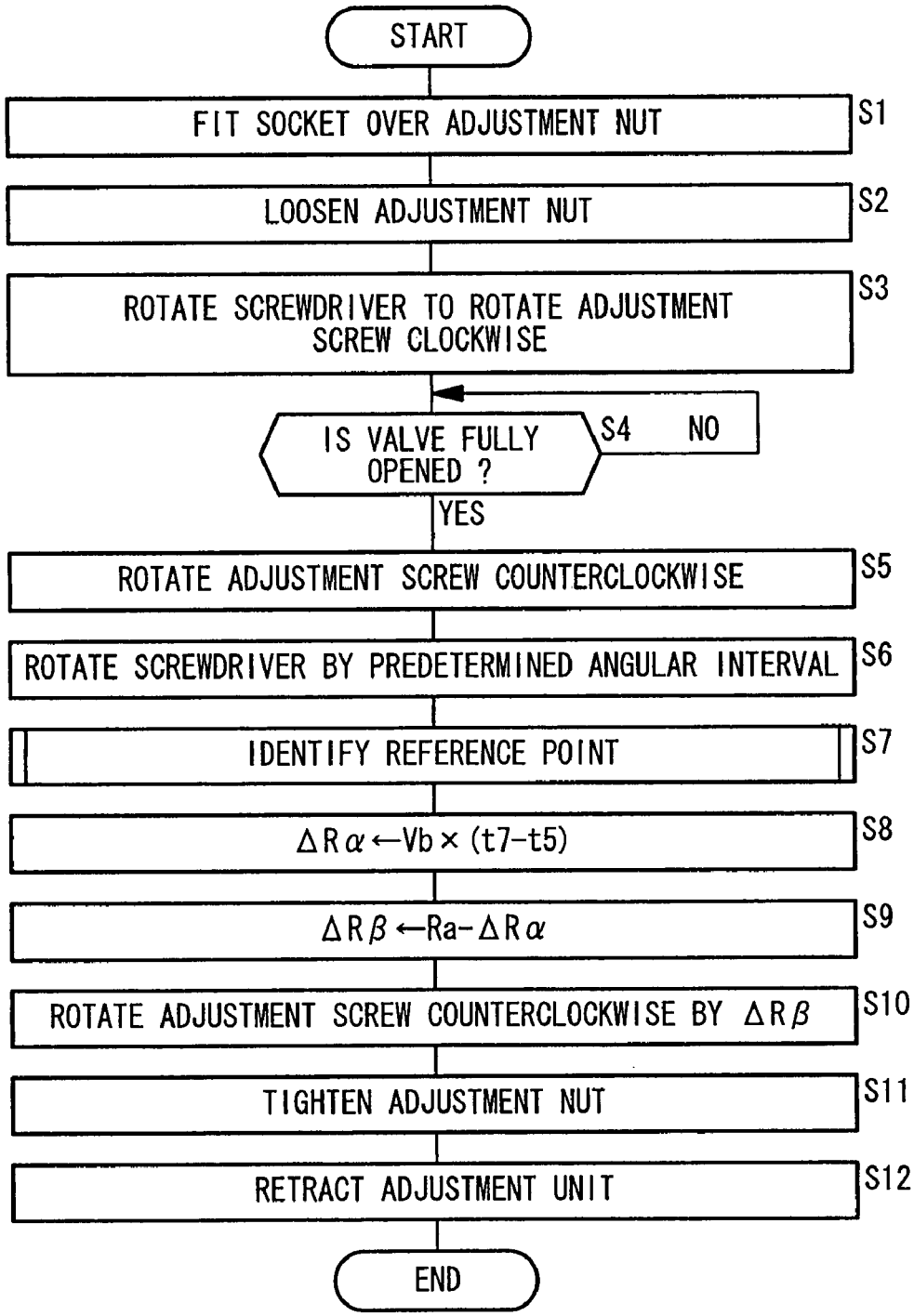
FIG. 7 is a flowchart showing a procedure of an automatic tappet clearance adjusting method according to the embodiment of the present invention.

A method of adjusting the tappet clearance C in the engine 12 using the automatic tappet clearance adjusting apparatus 10 thus constructed shall be described below with reference to FIG. 7.

In step S1, the robot controller 64 operates the robot 36 to move the adjustment unit 34 closely to the engine 12, and to cause the socket 76 of the working unit 70 (see FIG. 4) to be fitted over the adjustment nut 23. At this time, since the adjustment unit 34 is moved by the robot 36, which has a high degree of freedom, under programmed operations controlled by the robot controller 64, the adjustment unit 34 is flexible enough, even if the rocker arm 22 and the adjustment screw 18 have different positions and directions depending on the type of engine 12. A single automatic tappet clearance adjusting apparatus 10 can adjust the tappet clearances C of the cylinders of a multi-cylinder engine 12.

The distal end of the socket 76 floatingly abuts against the adjustment nut 23 and thereafter is fitted over the adjustment nut 23, whereupon the distal end of the socket 76 is seated on the rocker arm 22. Thereafter, the socket 76 moves slightly closer to the rotary tube 90 while resiliently compressing the spring 100, so that the distal end of the socket 76 is reliably fitted over the adjustment nut 23. Therefore, the robot 36 can bring the socket 76 into fitting engagement with the adjustment nut 23, in any desired position within a displacement range in which the spring 100 is resiliently deformable. At this time, the robot 36 can set the position and direction of the adjustment unit 34 based on the displacement of the rocker arm 22, which is measured by the magnescale 82, for thereby bringing the socket 76 into more reliable engagement with the adjustment screw 18.

At this time, the screwdriver 72 engages in the straight slot 18*a* of the adjustment screw 18 while resiliently compressing the spring 102.

In subsequent processes up to step S11, the robot 36 is synchronized in real time based on the displacement of the rocker arm 22, so as to bring the screwdriver 72 into accurate engagement within the straight slot 18*a*.

In step S2, the motor 114 of the nut runner 78 is energized to rotate the rotary tube 90 and the socket 76 in order to loosen the adjustment nut 23, thereby releasing the double-nut engagement applied by the adjustment nut 23 and the adjustment screw 18. The adjustment screw 18 is now made rotatable and can start to be adjusted by the screwdriver 72.

At this time, the adjustment nut 23 may be rotated in a direction so as to be loosened, while an increase in torque applied to the socket 76 can be detected by the torque detector 38 in order to confirm the fitting engagement between the socket 76 and the adjustment nut 23.

In step S3, the servomotor 110 of the screwdriver rotator 74 is energized to rotate the coupling rod 94 and the screwdriver 72, in order to rotate the adjustment screw 18 clockwise. The PLC 62 begins to measure the torque value T based on the measurement by the load cell 136 and the angular displacement R of the servomotor 110. The PLC 62 also measures the torque value and the angular displacement R successively at predetermined small time intervals. Since the screwdriver 72 is biased so as to engage the adjustment screw 18 by the spring 102 (see FIG. 3), angular displacement R of the screwdriver 72 is proportional to the distance that the adjustment screw 18 is advanced or retracted. Therefore, measuring and controlling the angular displacement R is equivalent to measuring and controlling the distance that the adjustment screw 18 is advanced or retracted.

Figure 8:
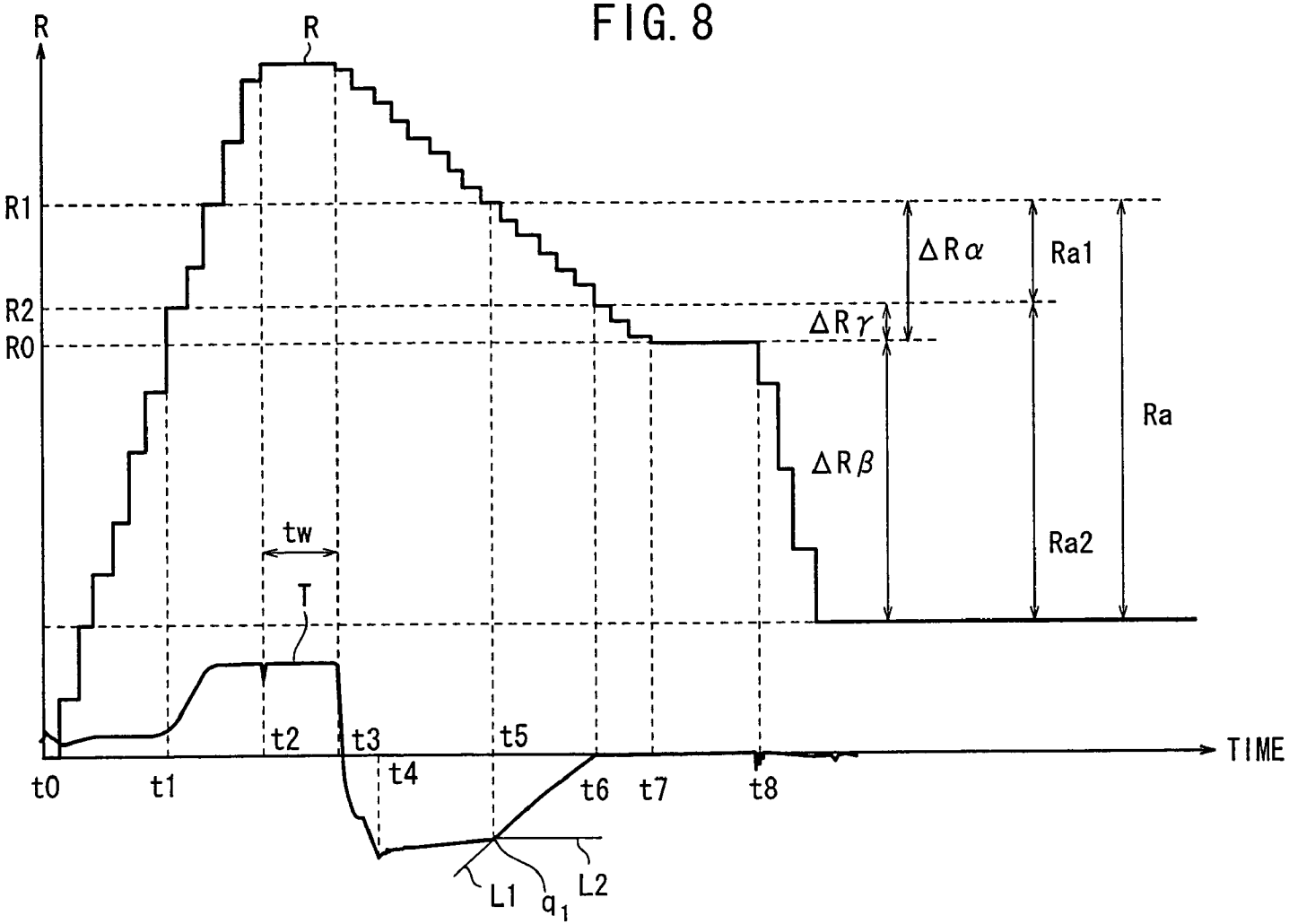
FIG. 8 is a graph of torque values and angular displacements for adjusting a tappet clearance.
Figure 9:
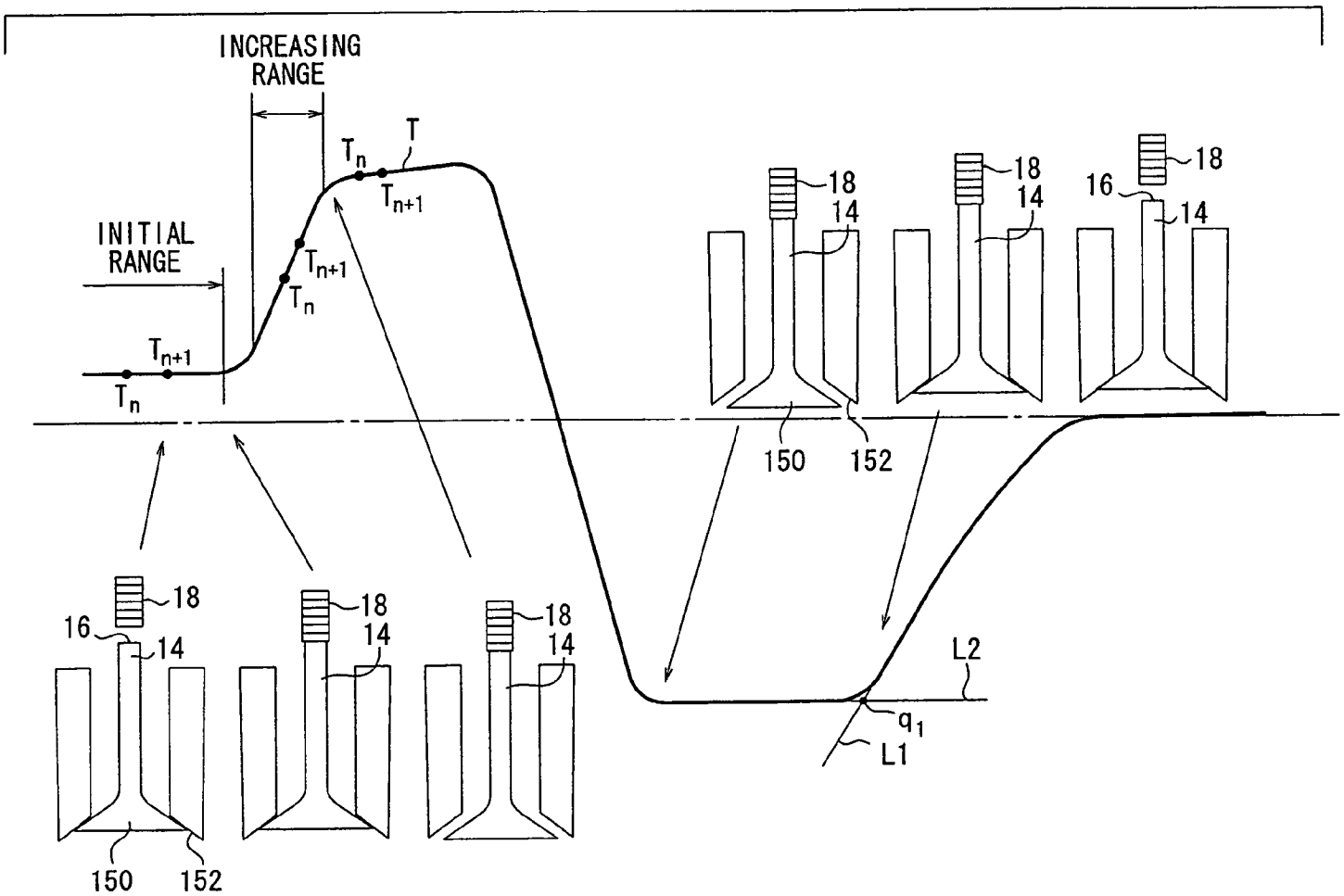
FIG. 9 is a diagram showing a comparison between torque value variations and valve states.

FIG. 8 is a graph of torque values T and angular displacements R measured by the PLC 62, with time at this point being represented by t0. FIG. 9 shows a comparison between variations of the torque values T and states of the valve 14.

Figure 10:
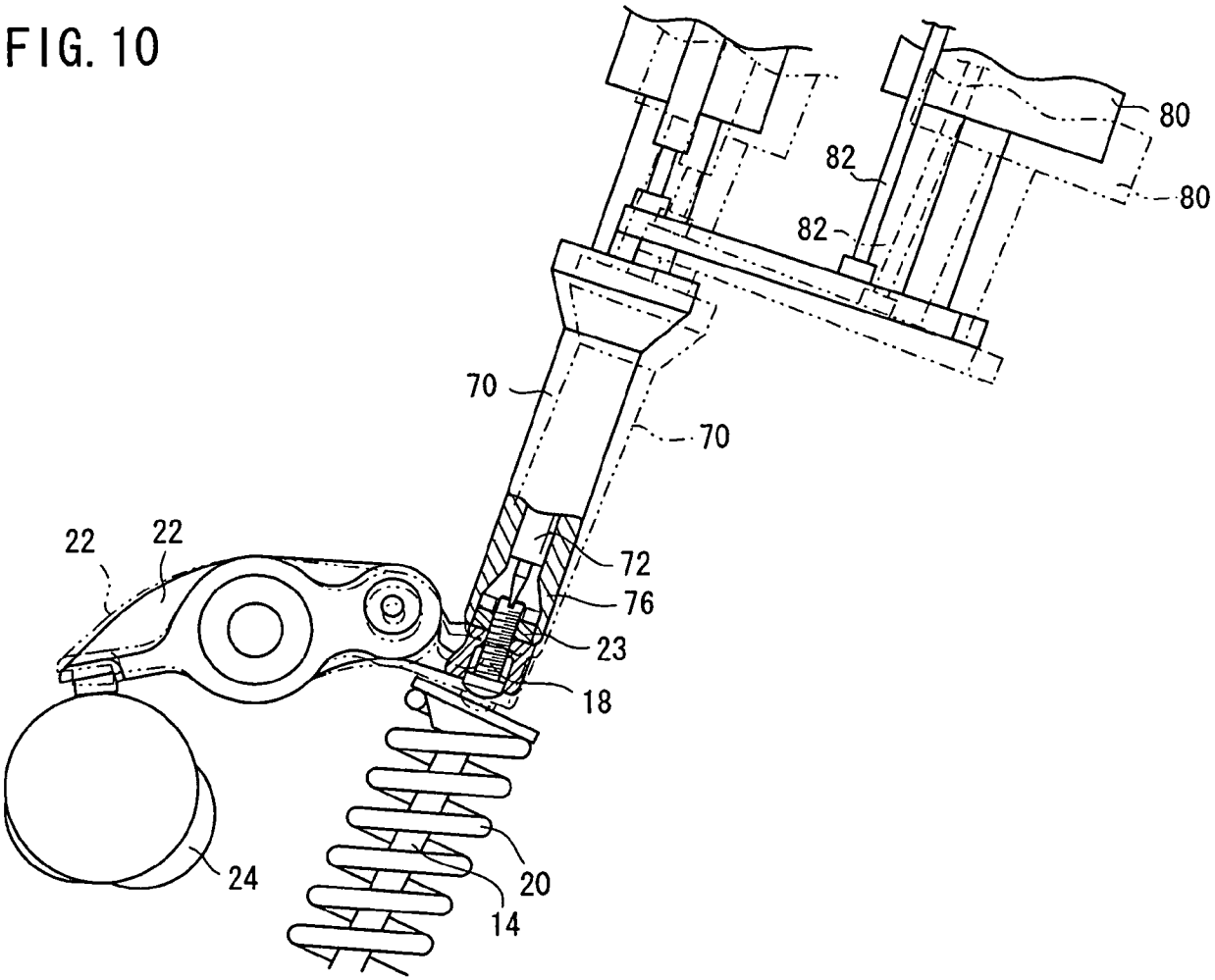
FIG. 10 is a view showing the manner in which the orientation of the adjustment unit is changed in synchronism with the displacement of a rocker arm.

As shown in FIG. 10, in step S3, based on displacement of the rocker arm 22 as detected by the magnescale 82, the adjustment unit 34 is operated in synchronism to achieve an appropriate position and direction for smoothly rotating the adjustment screw 18. Specifically, the adjustment unit 34 may be synchronized so as to make the adjustment screw 18 and the screwdriver 72 coaxial with each other.

Specifically, in a conventional tappet clearance adjusting apparatus, since a unit corresponding to the adjustment unit 34 is fixed, the screwdriver 72 may not be fitted accurately within the straight slot 18*a* of the adjustment screw 18, and the socket 76 may not be fitted accurately over the adjustment nut 23. By contrast, in the automatic tappet clearance adjusting apparatus 10, however, since the magnescale 82 can detect displacement of the rocker arm 22 in real time, and the adjustment unit 34 is mounted on a robot 36 having a high degree of freedom, the angle of approach can be changed in order to enable reliable and smooth adjustments while the robot 36 is maintained in synchronism with displacement of the rocker arm 22.

In step S4, measurements of the rotation of the adjustment screw 18 and the torque value T of the load cell 136 are continued in order to detect when the valve 14 is fully opened. Specifically, in FIG. 8, the torque value T starts increasing from a time t1 when the adjustment screw 18 first contacts the valve end 16. The valve 14 is fully opened at a time t2 when flexure, elongation, and backlash of the parts are eliminated. Subsequently, the torque value T gradually increases depending on the flexure of the spring 20. Step S4 is carried out as a subroutine (see FIG. 11). After the valve 14 is detected as being opened, control goes to step S5.

In step S5, the screwdriver rotator 74 operates to rotate the screwdriver 72 in the reverse direction so that the adjustment screw 18 starts rotating counterclockwise at time t3.

The torque value T is quickly reduced and its polarity is inverted. The torque value T is reduced until time t4 when the absolute value thereof becomes substantially equal to the value before its polarity was inverted. After time t4, the torque value T gradually increases (the absolute value decreases) depending on the flexure of the spring 20.

After a valve head 150 contacts a valve seat 152 at time t5, the torque value T quickly increases (the absolute value decreases). The parts are subjected to flexure, elongation and backlash, and the valve 14 is fully closed at time t6, with the adjustment screw 18 being spaced from the valve end 16. After time t6, the torque value T becomes substantially nil.

In step S6, the screwdriver 72 is rotated a predetermined angular interval, which is preset with respect to the position at time t3. The screwdriver 72 is stopped when the torque value T becomes substantially nil. The predetermined angular interval is set as a location before the torque value T becomes substantially nil and the tappet clearance C reaches an appropriate value. In FIG. 8, the angular position at the location is represented as a temporary stop position R0. The torque value T and the angular displacement R are recorded at small intervals, from time t3 to time t7, and are recorded substantially continuously.

In step S7, a time t5 at which the valve head 150 contacts the valve seat 152 is determined by a subroutine, and an angular reference position R1 corresponding to the time t5 is identified as a reference point. The subroutine shall be described subsequently (see FIG. 12).

In step S8, a differential angular displacement □R□ between the temporary stop position R0 and the angular reference position R1 is determined as □R□←Vb □(t7−t5), where Vb represents the rotational speed of the screwdriver 72. Alternatively, the differential angular displacement □R□ may be determined as □R□←R1−R0 based on the temporary stop position R0 and the angular reference position R1, which have been recorded corresponding to times t5 and t7.

In step S9, a differential angular displacement □R□ between a predetermined angular displacement Ra and the differential angular displacement □R□ is determined as □R□←Ra−□R□. The predetermined angular displacement Ra is determined as an angular displacement from the position at a given time (i.e., time t5) when the valve head 150 contacts the valve seat 152 and until the valve 14 moves to a position where the tappet clearance C reaches an appropriate value (e.g., 0.3 mm) that is preset in design. The predetermined angular displacement Ra is determined by calculation or experimentation and is recorded in advance.

Theoretically, the predetermined angular displacement Ra may be expressed as the sum of a first predetermined angular displacement Ra1, corresponding to time t5 to time t6, and a second predetermined angular displacement Ra2 corresponding to time t6 to time t7, wherein the first predetermined angular displacement Ra1 and the second predetermined angular displacement Ra2 are determined individually.

The first predetermined angular displacement Ra1 represents the difference between the angular reference position R1 corresponding to time t5 and an angular reference position R2 corresponding to time t6, determined based on flexure and elongation of the parts. The second predetermined angular displacement Ra2 is determined either experimentally or as a value produced by dividing the appropriate value of the clearance C, which is preset in design, by the pitch length of the adjustment screw 18.

In step S10, after time t8 (see FIG. 8) and at which the processing of step S9 is finished, the screwdriver 72 rotates the adjustment screw 18 counterclockwise from the reference position by the differential angular displacement □R□. The adjustment screw 18 is now retracted from the reference position, and the tappet clearance C reaches a value very close to the appropriate value that is preset in design. At this time, the screwdriver 72 stops being rotated.

In step S11, the nut runner 78 operates to tighten the adjustment nut 23, fixing the adjustment screw 18.

In step S12, the robot 36 operates to retract the adjustment unit 34. If another adjustment screw 18 remains unadjusted, then steps S1 through S11 are executed repeatedly on the unadjusted adjustment screw 18.

The subroutine in step S4 (see FIG. 7), for detecting when the valve 14 is fully opened, shall be described below with reference to FIG. 11.

In step S101, assuming that successively detected torque values T are represented by $T_n$ and $T_{n+1}$ (see FIG. 9), if a state wherein $T_{n+1}-T_n<K_1$ ($K_1$ and $K_2$ through $K_5$ indicate predetermined thresholds to be described later) occurs successively three times or more, then the torque value T is judged as being in a stable initial range, and control proceeds to step S103. If the condition is not satisfied, then the corresponding time is shifted by one sample (step S102), and step S101 is executed again.

If a state wherein $T_{n+1}-T_n>K_2$ occurs successively twice or more in step S103 after the initial range is determined in step S101, then the torque value T is judged as being within an increasing range, and control proceeds to step S105. If the condition is not satisfied, then the corresponding time is shifted by one sample (step S104), and step S103 is executed again.

Figure 11:
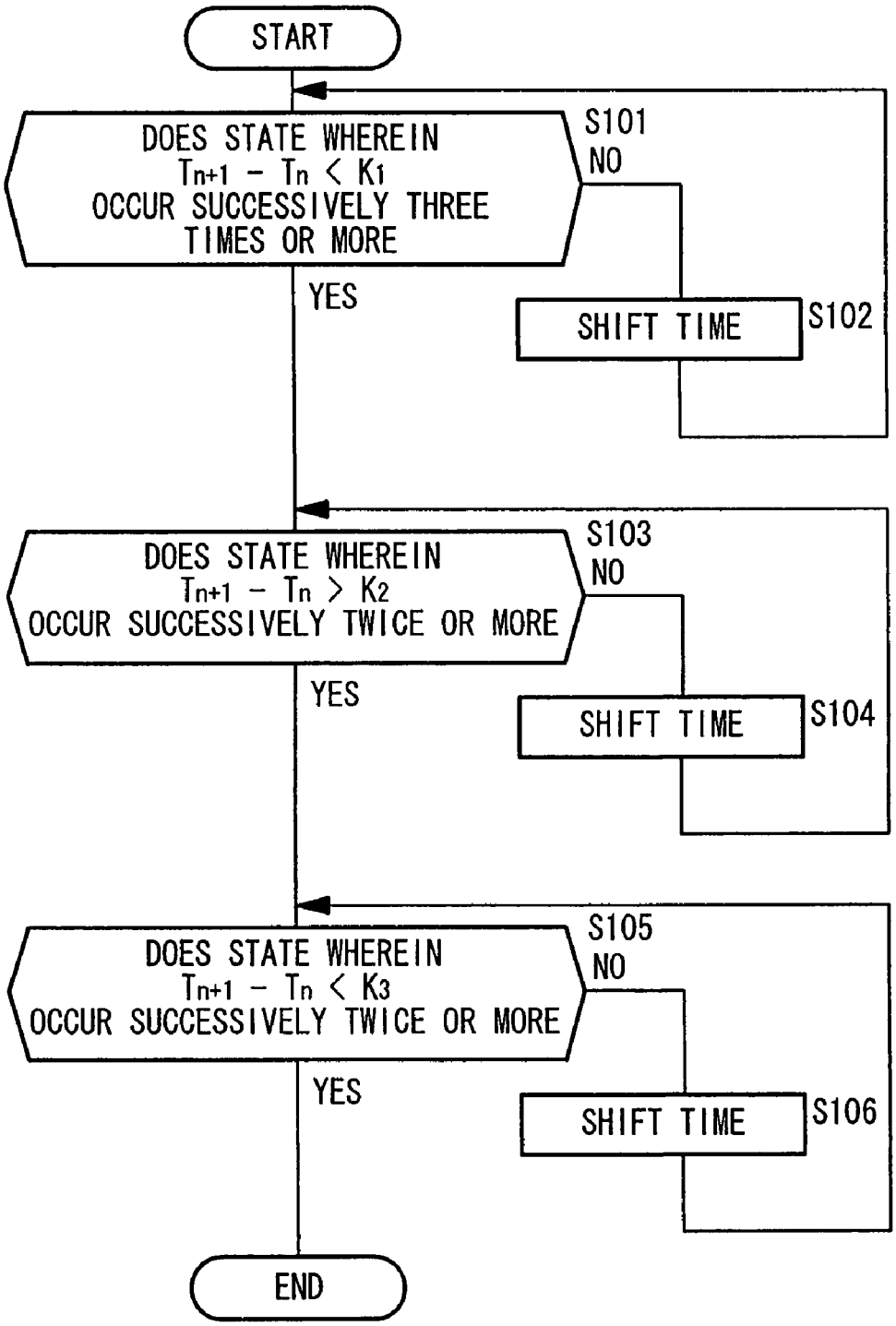
FIG. 11 is a flowchart of a subroutine for detecting when a valve is fully opened.

If a state wherein $T_{n+1}-T_n<K_3$ occurs successively twice or more in step S105 after the increasing range is determined in step S103, then since increasing of the torque value T has ended, the valve 14 is detected as being fully opened, and the process shown in FIG. 11 is put to an end. If the condition is not satisfied, then the corresponding time is shifted by one sample (step S106), and step S105 is executed again.

The processing of step S105 is essentially a differential process. If a state wherein a differential value is smaller than a predetermined threshold occurs successively a predetermined number of times, then the valve 14 is judged as being opened.

According to the above process, it is possible to reliably detect an increasing range, in which the torque value T increases based on flexure, etc., of the valve 14 after the adjustment screw 18 contacts the valve end 16, as well as to separately detect an initial range prior thereto and a subsequent zone in which the valve 14 is fully opened. Due to the processing of step S105, the valve 14 can reliably be advanced until it is fully opened.

Figure 12:
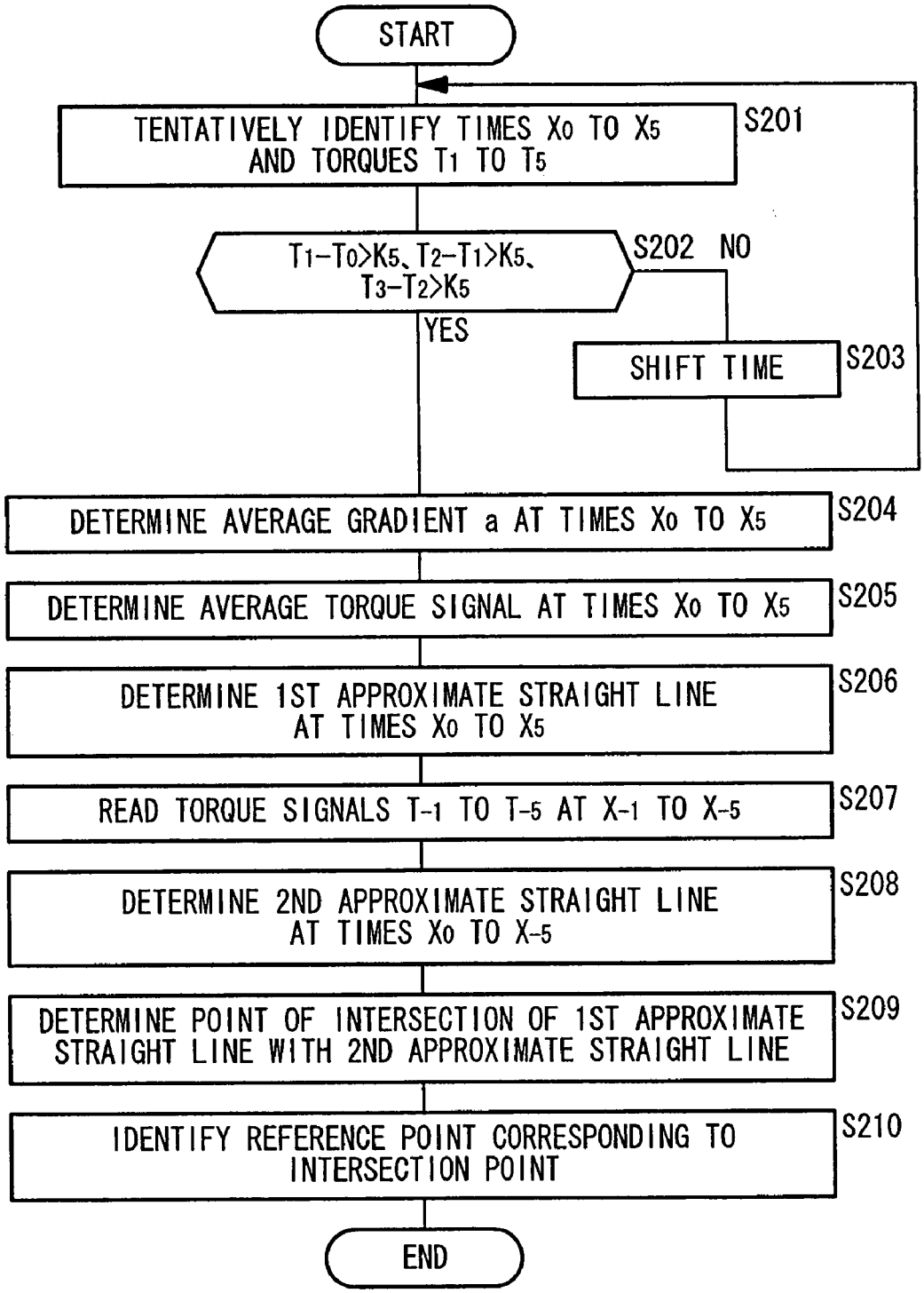
FIG. 12 is a flowchart of a subroutine for identifying a reference point.
Figure 13:
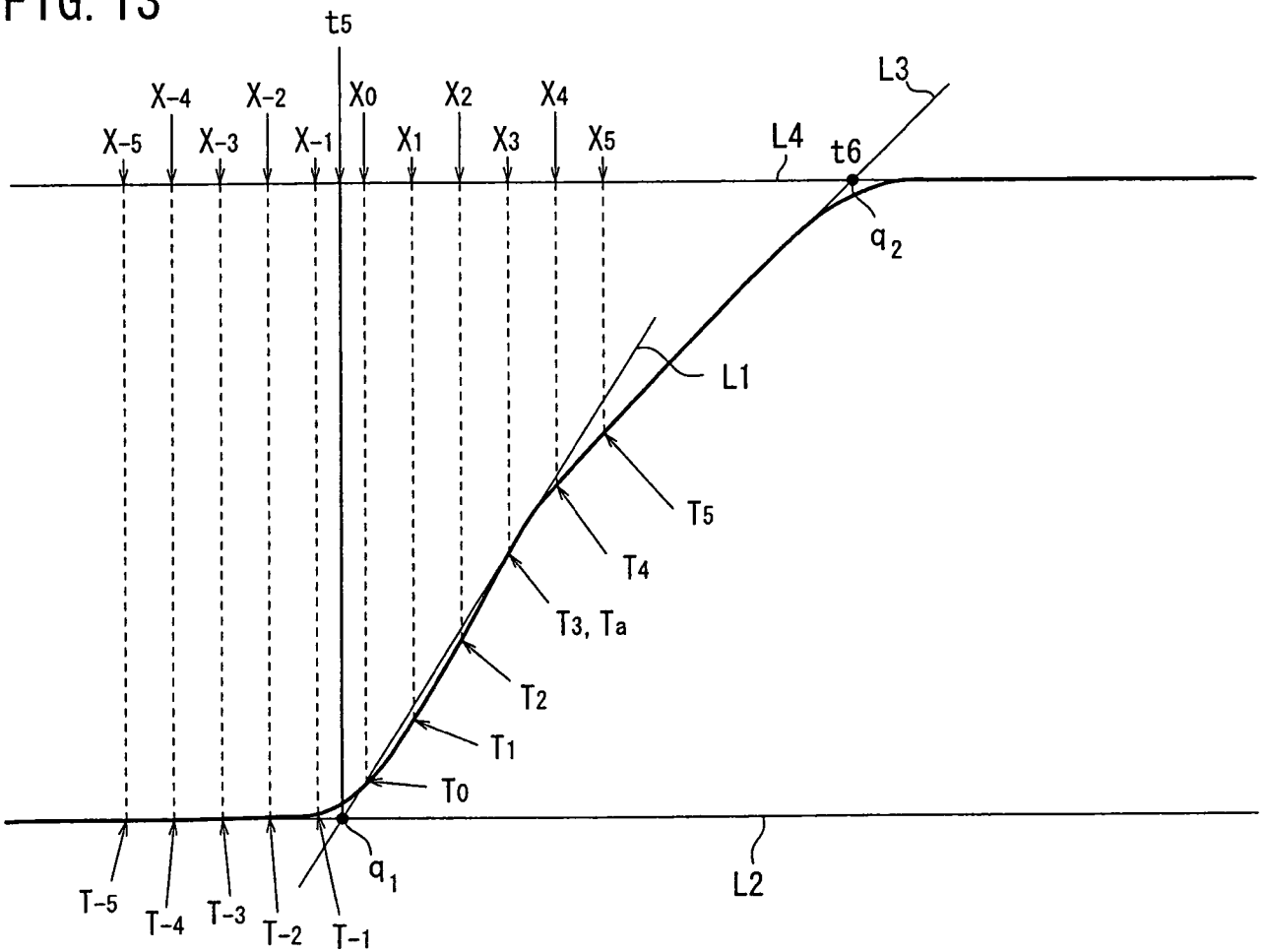
FIG. 13 is a graph showing, in an enlarged scale, torque values at a time when the valve is closed.

The subroutine in step S7, for identifying the angular reference position R1 corresponding to time t5 as a reference point, shall be described below with reference to FIGS. 12 and 13.

In step S201, the stored torque values T are successively retrieved. Using a retrieval time $X_0$ and a torque $T_0$ at the retrieval time $X_0$ as a reference, five successive times $X_1$, $X_2$, $X_3$, $X_4$, $X_5$ and torques $T_1$, $T_2$, $T_3$, $T_4$, $T_5$ corresponding to these times are tentatively identified.

In step S202, it is confirmed whether or not $T_1-T_0>K_4$, $T_2-T_1>K_4$, and $T_3-T_2>K_4$. If these conditions are satisfied, then it is judged that the curve of the torque value T is reliably increasing, and a zone in excess of time t5 is confirmed. Control then goes to step S204. If the condition is not satisfied, then the corresponding time $X_0$ is shifted by one sample (step S203), and control goes back to step S201 to retrieve the torque values again.

Times $X_0$ through $X_5$ thus identified are in the vicinity of time t5, and are identified as a zone within substantially the former half of times t5 to t6.

The processing of step S202 is essentially a differential process, wherein time $X_0$ corresponds to an inflection point where the differential value of the torque T changes.

In step S204, an average gradient "a" of the torque values T at times $X_0$ through $X_5$ is determined. Specifically, since six points $(X_0, T_0)$, $(X_1, T_1)$, $(X_2, T_2)$, $(X_3, T_3)$, $(X_4, T_4)$, $(X_5, T_5)$ are obtained based on the processing of step S201, five gradients a1, a2, a3, a4, a5 between the adjacent points are determined, and thereafter the average gradient a of these gradients is determined as $a \leftarrow (a1+a2+a3+a4+a5)/5$. For example, the gradient a1 between point $(X_0, T_0)$ and point $(X_1, T_1)$ is determined as $a1 \leftarrow (T_1-T_0)/(X_1-X_0)$.

In step S205, an average Ta of the torque values T at times $X_0$ through $X_5$ is determined as $Ta \leftarrow (T_1+T_2+T_3+T_4+T_5)/5$. The average Ta is a typical one of the torque values T at times $X_0$ through $X_5$, and corresponds to the time $X_3$ as an intermediate time.

In step S206, a first approximate straight line L1 representing the torque values T at times $X_0$ through $X_5$ is determined. The first approximate straight line L1 is expressed by $T=a \cdot t+b1$ where T represents a torque value, "t" a parameter of time, "a" the gradient determined in step S204, and "b1" an offset that is determined as $b1 \leftarrow Ta-a \cdot X_3$ using the average Ta determined in step S205.

In step S207, torque values $T_{-1}$, $T_{-2}$, $T_{-3}$, $T_{-4}$, $T_{-5}$ at five successive times $X_{-1}$, $X_{-2}$, $X_{-3}$, $X_{-4}$, $X_{-5}$ prior to the time $X_0$ are read.

In step S208, a second approximate straight line L2, representing the torque values T at times $X_5$ through $X_0$, is determined. The second approximate straight line L2 has a time-independent constant value and is expressed by T=b2, where b2 represents an offset that is determined as $b2 \leftarrow (T_{-1}+T_{-2}+T_{-3}+T_{-4}+T_{-5})/5$. As with the first approximate straight line L1, the second approximate straight line L2 may be approximated as a straight line having a predetermined gradient. The first approximate straight line L1 and the second approximate straight line L2 may be replaced with two approximate curves, of the second order or higher, based on a least-squares method or the like.

In step S209, a point $q_1$ of intersection between the first approximate straight line L1 and the second approximate straight line L2 is determined, and the corresponding time is identified as a time t5 when the valve head 150 contacts the valve seat 152.

In step S210, the angular reference position R1, corresponding to the intersection point $q_1$ and time t5, is retrieved from memory or is determined according to a predetermined interpolating process, and identified as a reference point. Thereafter, based on the determined angular reference position R1, processing from step S8 (see FIG. 7) is performed to adjust the tappet clearance C.

As described above, with the automatic tappet clearance adjusting apparatus 10 according to the present embodiment, since torque values T are successively measured when the valve 14 is closed by retracting the adjustment screw 18, a time $X_0$ when the differential value of the torque value T changes can reliably be identified. Since the point $q_1$ of intersection is determined between the first approximate straight line L1, which approximates the zone immediately after time $X_0$, and the second approximate straight line L2, which approximates the zone immediately before time $X_0$, the first approximate straight line L1 and the second approximate straight line L2 are established in the vicinity of the inflection point. Even when the torque value T between times t5 and t6 changes along a curve (see FIG. 13), the latter part of the curve is independent of the first approximate straight line L1, and the intersection point $q_1$, corresponding to time t5 when the valve head 150 contacts the valve seat 152, can accurately be determined. As a result, the angular reference position R1 can accurately be identified.

According to the process of identifying the point at which the adjustment screw 18 is brought into contact with the valve 14 as a reference point, it may be difficult to identify the reference point highly accurately due to individual variability of the screw section of the adjustment screw 18. However, with the automatic tappet clearance adjusting apparatus 10 according to the present embodiment, since the angular reference position R1 corresponding to the inflection point of the torque value T at the time the valve 14 is retracted is identified as a reference point, the reference point can be identified highly accurately regardless of play in the screwdriver 72 that engages in the straight slot 18*a* of the adjustment screw 18, or backlash of the drive system, etc.

All of the processes performed by the automatic tappet clearance adjusting apparatus 10 for adjusting tappet clearance are automatically carried out under the control of the control mechanism 54. Therefore, the automatic tappet clearance adjusting apparatus 10 is effective as a labor saver for several workers, and the apparatus is capable of adjusting tappet clearances more quickly and accurately than workers. Furthermore, inasmuch as the automatic tappet clearance adjusting apparatus 10 can selectively and flexibly carry out a plurality of operations under a programmed control, the apparatus is suitable for adjusting a large quantity of engines 12 having a wide variety of engine types.

The engine 12 that is adjusted by the automatic tappet clearance adjusting apparatus 10 is a complete product made up of an assembly of major components including a cylinder head, pistons 26, and a crankcase. The adjustment process is done as an independent process after the assembling process for the engine 12 has been completed. Since no subsequent assembling process is required, the adjustment once it has been made is not changed. The adjustment process is also simple, since no advance disassembling process is needed.

Since the automatic tappet clearance adjusting apparatus 10 does not have any means for fixing the rocker arm 22, the rocker arm 22 may slightly be displaced upon adjustment. However, since the automatic tappet clearance adjusting apparatus 10 successively measures the torque value T, and identifies a reference point based on the differential value of the torque value T, the apparatus can adjust tappet clearances independently of the displacement of the rocker arm 22, and thus can adjust the tappet clearance with a simple structure, since no means for fixing the rocker arm 22 is required.

In the above embodiment, the intersection point $q_1$ is determined based on a time t5 when the valve head 150 contacts the valve seat 152, whereupon the angular reference position R1 corresponding to the intersection point $q_1$ is identified as a reference point. However, an intersection point $q_2$ (see FIG. 13) based on a time t6 when the adjustment screw 18 is spaced from the valve end 16 may be determined, wherein an angular reference position R2 corresponding to the intersection point $q_2$ (see FIG. 13) may be identified as a reference point. In this case, it is confirmed in step S202 whether or not $T_1-T_0>K_5$, $T_2-T_1>K_5$, and $T_3-T_2>K_5$. If these conditions are satisfied, then it is judged that the torque value T has converged to a constant value, and a zone in excess of time t6 is confirmed. The process performed in steps S204 through S206 with respect to times $X_0$ through $X_5$ may be replaced with a process with respect to times $X_0$ through $X_5$. An equation representative of a third approximate straight line L3 (see FIG. 13), which approximates a zone immediately prior to time t6, is thus determined.

The process with respect to times $X_0$ through $X_5$ in step S208 may be replaced with a process with respect to times $X_1$ through $X_5$, to determine an equation representative of a fourth approximate straight line L4 (see FIG. 13), which approximates a zone immediately subsequent to time t6. Actually, the fourth approximate straight line L4 is of a constant value independent of time t. If it is obvious that the torque T is substantially nil after time t6, then the fourth approximate straight line L4 may be approximated as T=0.

Thereafter, in a process corresponding to step S209, a point $q_2$ of intersection between the third approximate straight line L3 and the fourth approximate straight line L4 is determined to thereby identify the time t6. Then, a differential angular displacement $\Delta R\gamma$ (=R2−R0) between the angular reference position R2 corresponding to time t6 and the temporary stop position R0 is determined, and further, the differential angular displacement $\Delta R\beta$ between the second predetermined angular displacement Ra2 and the differential angular displacement $\Delta R\gamma$ is determined as $\Delta R\beta \leftarrow Ra2-\Delta R\gamma$. As described above, the second predetermined angular displacement Ra2 is determined either experimentally or as a value produced by dividing an appropriate value of the clearance C, which is preset in design, by the pitch length of the adjustment screw 18.

The angular reference positions R1, R2, which serve as reference points for adjusting the tappet clearance C, can thus be determined based on the intersection points $q_1$, $q_2$ corresponding to times t5 and t6. Either one of the locations may be used as a reference point, based on experiments and studies conducted for each type of engine 12, wherein a process based on an optimum location may be selected.

The torque detector 38 has been described above as being of a type having a single load cell 136 (see FIG. 5). However, two load cells 136 may be employed for individually detecting torque values T for clockwise rotation and counterclockwise rotation, respectively. In this case, the preloading spring 138 may be dispensed with.

The automatic tappet clearance adjusting apparatus and adjusting method according to the present invention is not limited to the above embodiments, but may have various arrangements without departing from the gist of the present invention.

The invention claimed is:

1. An automatic tappet clearance adjusting apparatus for adjusting a clearance between a valve and an adjustment screw in an engine, in which the valve that is closed by a spring is opened by being pressed by an adjustment screw on a distal end of a rocker arm, comprising:

an adjustment unit for advancing and retracting said adjustment screw from a distal end of said rocker arm to adjust a projection of the adjustment screw;

a torque detector for detecting a torque to rotate said adjustment screw; and a control mechanism for controlling said adjustment unit based on a torque value measured by said torque detector, wherein said control mechanism successively detects said torque value applied to retract said adjustment screw to close said valve from a state in which said valve is open, and detects, as a reference point, a point of intersection of a first straight line, which corresponds to a time zone immediately before an inflection point at which a differential value of said torque value changes, with a second straight line which corresponds to a time zone immediately after the inflection point, and then retracts said adjustment screw by a set quantity based on said clearance from said reference point.

2. An automatic tappet clearance adjusting apparatus according to claim 1, wherein said control mechanism detects, as the reference point, a location in which a valve head of said valve first contacts a valve seat of said engine to begin reducing said torque value.

3. An automatic tappet clearance adjusting apparatus according to claim 1, wherein said control mechanism detects, as the reference point, a location in which after a valve head of said valve contacts a valve seat of said engine, said adjustment screw is spaced from an end of said valve to hold said torque value at a constant value.

4. An automatic tappet clearance adjusting apparatus according to claim 1, wherein said torque detector comprises:

a drive unit connected to a rotary drive source;

a driven unit coupled to a tool for rotating said adjustment screw, said driven unit being coaxial with said drive unit;

a drive force transmitting engagement unit for transmitting rotation in both directions of said drive unit to said driven unit; and a load cell disposed in said drive force transmitting engagement unit, for detecting a force in one circumferential direction, wherein said load cell is preloaded in said one circumferential direction by a resilient body.

5. An automatic tappet clearance adjusting apparatus according to claim 1, further comprising:

a rocker arm measuring unit for detecting a displacement of said rocker arm; and a moving mechanism programmed for setting a position and direction of said adjustment unit, wherein said moving mechanism sets the position and direction of said adjustment unit based on the displacement of the rocker arm measured by said rocker arm measuring unit, and brings said adjustment unit into engagement with said adjustment screw.

6. An automatic tappet clearance adjusting apparatus according to claim 1, wherein said adjustment unit is moved by a programmable multiaxis robot.

7. An automatic tappet clearance adjusting apparatus according to claim 1, wherein the tappet clearance adjusting apparatus is installed in a station on a production line.

8. An automatic tappet clearance adjusting method, for adjusting a clearance between a valve and an adjustment screw in an engine in which the valve that is closed by a spring is opened by being pressed by an adjustment screw on a distal end of a rocker arm comprising the step of employing:

an adjustment unit for advancing and retracting said adjustment screw from the distal end of said rocker arm in order to adjust the projection of the adjustment screw;

a torque detector for detecting a torque value to rotate said adjustment screw; and a control mechanism for controlling said adjustment unit based on the torque value as measured by said torque detector, wherein said control mechanism successively detects said torque value applied to retract said adjustment screw to close said valve from a state in which said valve is open, and detects, as a reference point, a point of intersection of a first straight line, which corresponds to a time zone immediately before an inflection point at which a differential value of said torque value changes, with a second straight line which corresponds to a time zone immediately after the inflection point, and then retracts said adjustment screw by a set quantity based on said clearance from said reference point.

9. An automatic tappet clearance adjusting method according to claim 8, wherein said control mechanism detects, as the reference point, a location at which a valve head of said valve first contacts a valve seat of said engine to begin reducing said torque value.

10. An automatic tappet clearance adjusting method according to claim 8, wherein said control mechanism detects, as the reference point, a location in which, after a valve head of said valve contacts a valve seat of said engine, said adjustment screw is spaced from an end of said valve in order to hold said torque value at a constant value.

11. An automatic tappet clearance adjusting method according to claim 8, wherein said torque detector comprises:

a drive unit connected to a rotary drive source;

a driven unit coupled to a tool) for rotating said adjustment screw, said driven unit being coaxial with said drive unit;

a drive force transmitting engagement unit for transmitting rotation in both directions of said drive unit to said driven unit; and a load cell disposed in said drive force transmitting engagement unit, for detecting a force in one circumferential direction, wherein said load cell is preloaded in said one circumferential direction by a resilient body.

12. An automatic tappet clearance adjusting method according to claim 8, further comprising the step of employing:

a rocker arm measuring unit for detecting a displacement of said rocker arm; and a moving mechanism programmed for setting a position and direction of said adjustment unit, wherein said moving mechanism sets the position and direction of said adjustment unit based on the displacement of the rocker arm measured by said rocker arm measuring unit, and brings said adjustment unit into engagement with said adjustment screw.

13. An automatic tappet clearance adjusting method according to claim 8, wherein said adjustment unit is moved by a programmable multiaxis robot.

14. An automatic tappet clearance adjusting method according to claim 8, wherein the tappet clearance adjusting method is carried out in a station on a production line.

* * * * *